United States Patent [19]

Nakao et al.

[11] Patent Number: 4,887,073

[45] Date of Patent: Dec. 12, 1989

[54] CEILING MOUNTED FIRE DETECTOR ASSEMBLY

[75] Inventors: Kouichi Nakao, Mie; Akira Toki, Tsu; Kazushige Morisue, Mie; Hiroyasu Kobayashi, Suzuka, all of Japan

[73] Assignee: Matsushita Electric Works, Ltd., Osaka, Japan

[21] Appl. No.: 274,564

[22] Filed: Nov. 22, 1988

[30] Foreign Application Priority Data

Apr. 8, 1988 [JP] Japan ..... 63-87642

[51] Int. Cl.[4] ..... G08B 17/10; H01R 13/50

[52] U.S. Cl. ..... 340/693; 340/628

[58] Field of Search ..... 340/628–630, 340/693; 174/50, 52.1, 59; 361/380, 427; 439/537, 536, 775, 913

[56] References Cited

U.S. PATENT DOCUMENTS

| | | | |
|---|---|---|---|
| 3,900,795 | 8/1975 | Larsen | 340/629 |
| 4,017,733 | 4/1977 | Ishii et al. . | |
| 4,236,822 | 12/1980 | Jaretsky | 340/628 |
| 4,315,594 | 2/1982 | Niederöst | 340/693 |
| 4,702,452 | 10/1987 | Penar | 340/628 |

FOREIGN PATENT DOCUMENTS

| | | | |
|---|---|---|---|
| 0111156 | 11/1983 | European Pat. Off. . | |
| 0142827 | 11/1984 | European Pat. Off. . | |
| 58-94089 | 6/1983 | Japan . | |
| 0633122 | 11/1982 | Switzerland | 340/629 |

*Primary Examiner*—Joseph A. Orsino
*Assistant Examiner*—Kinfe-Michael Negash
*Attorney, Agent, or Firm*—Armstrong, Nikaido, Marmelstein, Kubovcik & Murray

[57] ABSTRACT

A ceiling mounted fire detector comprises a detector 10 and a mount base 20 installed into a ceiling surface 1. The detector 10 includes a sensor unit 12 which, upon sensing a fire condition, produces an electrical signal to be transmitted to a control center through a signal line routed in the ceiling. The mount base 20 is provided in the form of a bottom-opened and top-closed barrel to receive therein the detector 10. Provided on the detector 10 is a pair of conductor prongs 15 by which the detector 10 is electrically and physically connected to the mount base 20. The mount base 20 includes a pair of sockets 23 for connection with the conductor prongs 15 and includes corresponding number of terminals 25 for wiring connection with the signal line for completing the electrical path from the detector 10 to the signal line. The terminals 25 are disposed together with the sockets 23 on the exterior of the top wall 21 of the mount base 20 for easy wiring connection with the signal line without being interfered with the body of the mount base 20. Accordingly, the mount base 20 can have a reduced size without sacrificing the convenience of the wiring connection, contributing to successfully reducing the total size of the detector and mount base assembly.

6 Claims, 8 Drawing Sheets

CEILING MOUNTED FIRE DETECTOR ASSEMBLY

BACKGROUND OF THE INVENTION

1. Field of the Invention

The present invention is directed to a ceiling mounted fire detector assembly, and more particular to a mounting structure of a fire detector and its mount base assembly.

2. Description of the Prior Art

There have been proposed various types of ceiling mounted fire detectors which are detachably received into a mounted base installed to a ceiling surface. Such fire detectors are designed to send an electric alarm signal upon sensing a fire condition to a central control center through a signal line routed within the ceiling. For detachable mounting of the detector, it has been common to provide a pair of conductor prongs or the like rigid conductors on the detector for physically and electrically connect the detector to a corresponding pair of sockets which is provided on the mount base and is wired to the signal line through corresponding terminal screws. Such detector and mount base assembly has been known, for example, in Japanese Utility Model Publication (KOKAI) No. 58-94089. As seen in the prior art, the mount base in the form of a top-closed and bottom-open barrel is provided with the terminal screws on the interior surface of the barrel together with the sockets. Thus, the mount base is required to have an entrance hole for drawing the wires from the ceiling into the mount base for wiring connections with the terminal screws. Such entrance hole is normally formed centrally of the top wall of the mount base with the screw terminals arranged along the periphery of the entrance hole, as seen also in FIG. 14a of U.S.P. 4,017,733 which shows the like detector mounting structure. This structure imposes a severe limitation on reducing the size, particularly the diameter of the mount base because the wiring operation cannot be done easily without enough interior space afforded to the mount base. Otherwise, the wiring connections would be restricted within the limited interior space of the mount base and not be successful at such an elevated site on the ceiling. Due to this limitation, the prior art mount base is not permitted to have a reduced size, which in turn prohibits the total compact arrangement of the detector and mount base assembly, although the compact arrangement is highly demanded for making the detector less conspicuously and giving an improved aesthetically pleasing appearance.

SUMMARY OF THE INVENTION

The present invention eliminates the above problem and provides an improved structure of ceiling mounted fire detector assembly. The assembly in accordance with the present invention comprises a detector body and a mount base secured to a ceiling surface to detachably receive therein the detector body. The mount base is a bottom-opened and top-closed barrel which fits in an opening in the ceiling surface and is secured thereto by means of fastening screws extending through a flange at the lower end of the mount base. Included in the detector body is a sensor unit which has an inlet port at the lower end of the detector body to permit the entry of air for fire detection. Upon sensing of a fire condition, the sensor unit produces an electric signal to be transmitted to a signal line routed within the ceiling.

The detector body is provided on its top with a pair of conductor prongs for electrical connection as well as physical coupling with a corresponding pair of sockets formed on the outer top end of the mount base. The conductor prongs extend through respectively through slots in the top wall of the mount base and come into engagement with the sockets upon being rotated about an upright axis of the detector body. The sockets thus supporting the detector body are each electrically connected to each of terminals which are formed also on the outer surface of the top wall of the mount base for wiring connection with the signal line in the ceiling. With this arrangement, the wiring connections at the terminals to the signal line can be made easily exteriorly of the mount base without interference with the body of the mount base, thus making it possible to reduce the size of the mount base to an reasonable extent without sacrificing the convenience of wiring operation.

Accordingly, it is a primary object of the present invention to provide a ceiling mounted fire detector assembly which is capable of facilitating the wiring connection to a signal line routed in the ceiling while enabling the whole assembly to be made compact.

The assembly further includes a head cap detachable to the top of the detector body for shielding the terminals and includes a bottom cover ring attached to conceal mount holes in the flange through which the heads of the fastening screws are viewed. With the inclusion of the head cap and cover ring, the terminals can be effectively protected from any hazard possible in the ceiling, in addition that the flange of mount base can be finished to have a pleasant appearance, which is therefore another object of the present invention.

Preferably, the mount base has at its lower end a test lamp and has on its outer top wall a printed board carrying a driving circuit of the test lamp. The driving circuit is electrically inserted between the terminal and the test lamp through conductor leads extending along the outer side wall of the mount base such that said test lamp is turned on in response to the detection of a fire condition by the sensor unit. Since the test lamp is provided on the side of the mount base fixed to the ceiling, it can be kept oriented to a desired direction, for example, a door of a room under surveillance for easy confirmation of the test lamp from one point or at the site of the door when the system is checked by simulating the fire. This is particularly advantageous when a number of fire detectors are mounted with all of their test lamps being oriented toward one particular point for immediate checking of all the detectors, it is therefore a further object of the present invention.

For an easy checking purpose, the mount base includes a pair of test pins which are connected to the terminals respectively for transmitting a test signal simulating the detection of a fire condition. One end of each test pin is exposed onto the interior surface of the mount base to be readily accessible through the interior of the mount base from which the detector is detached such that only the test pins are exposed interior of the mount base while concealing therebehind the other electrical conductive members including the terminals and sockets.

It is therefore a still further object of the present invention to provide a ceiling mounted fire detector assembly in which test pins are readily and reliably accessible for simulation of fire without being interfered or missed with other electrical conductive parts like the terminals and sockets.

The improved assembly of the present invention has still further advantageous features for facilitating the fixture of the mount base to the ceiling surface by utilizing unique clamp strips in combination with the fastening screws.

These and still other advantages and objects will become more apparent from the following description of a preferred embodiment of the present invention when taken in conjunction with the attached drawings.

DETAILED DESCRIPTION OF THE PREFERRED EMBODIMENT

Figure 1:
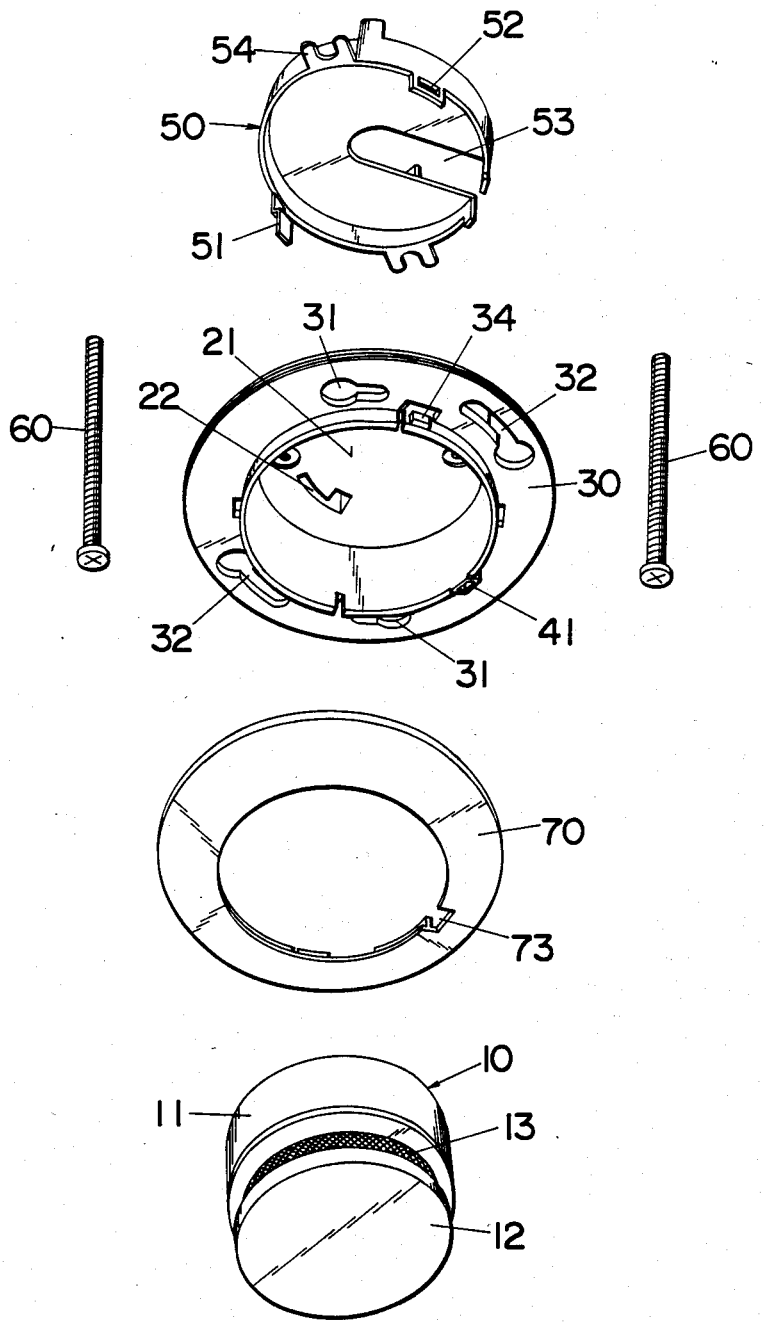
FIG. 1 is an exploded perspective view of a ceiling mounted fire detector assembly when viewed from the below in accordance with a preferred embodiment of the present invention.
Figure 2:
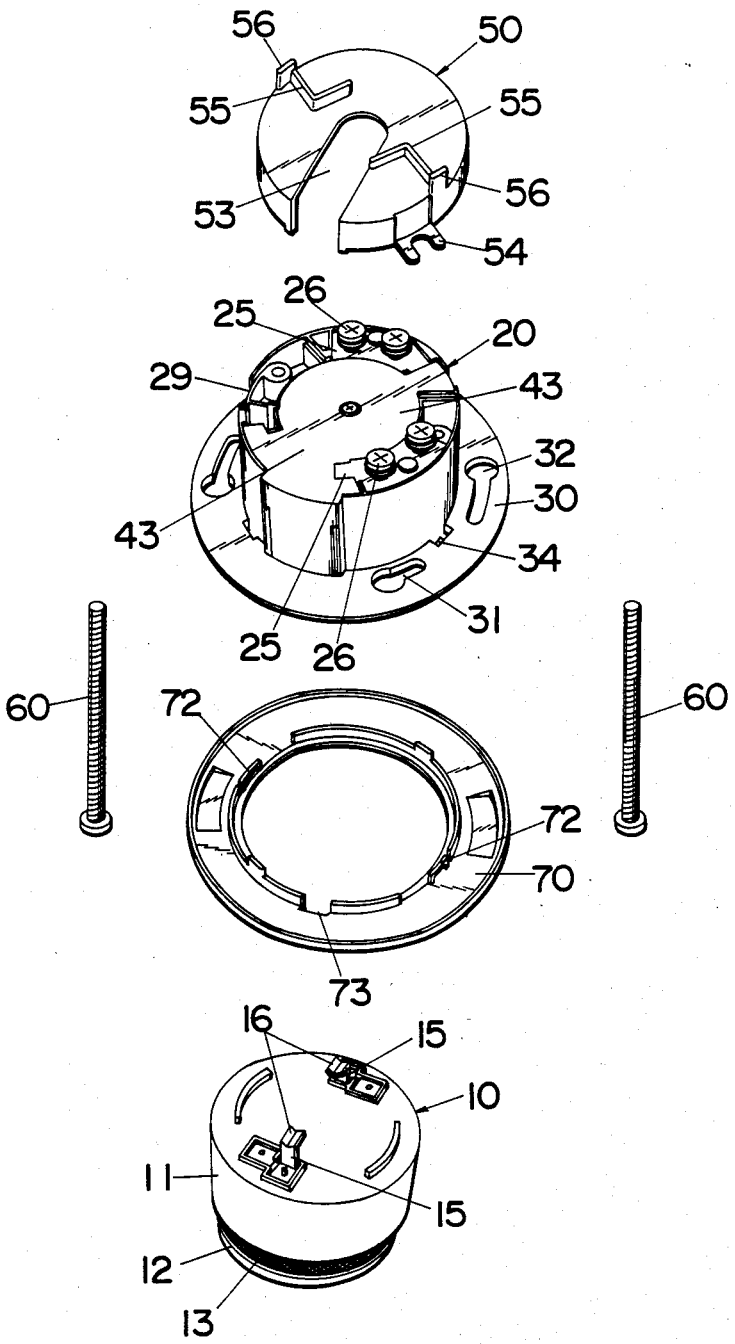
FIG. 2 is a like exploded perspective view of the assembly as viewed from the above.

Referring now to FIGS. 1 and 2, a ceiling mounted fire detector assembly in accordance with a preferred embodiment is shown to comprise a detector body 10 and a mount base 20 adapted to be fixed to a ceiling surface. The detector body 10 includes a cylindrical housing 11 holding a sensor unit 12 with an inlet port 13 permitting the entry of air for detection of fire. The sensor unit 12, which may be a smoke density sensor of photoelectric or ionization type or may be a heat-sensor, produces an electric signal upon sensing of a fire condition. The sensor unit 12 of a suitable type is attached to the housing 11 with internal leads (not shown) connected respectively to a pair of conductor prongs 15 projecting on the top of the housing 11 so as to make up the detector body 10. The conductor prongs 15 are positioned on the periphery of the top end of the detector body 10 in a symmetrical relation about an upright center axis of the detector body 10 and are formed at the respective upper ends with inwardly bent hooks 16.

Figure 7A:
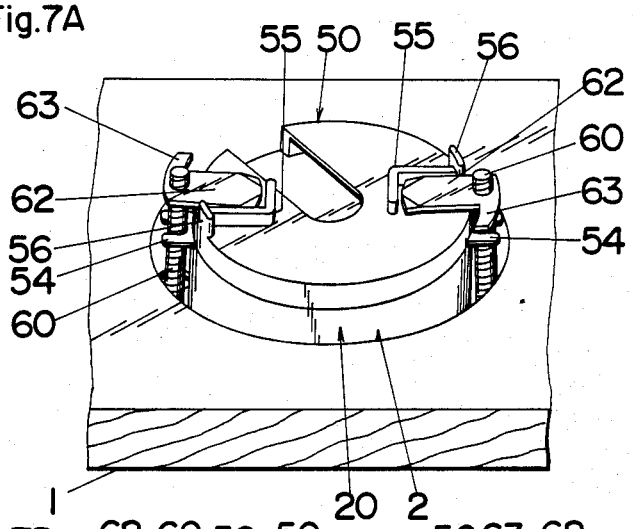
FIGS. 7A to 7C are explanatory views respectively illustrating the installation procedure of the mount base.
Figure 7B:
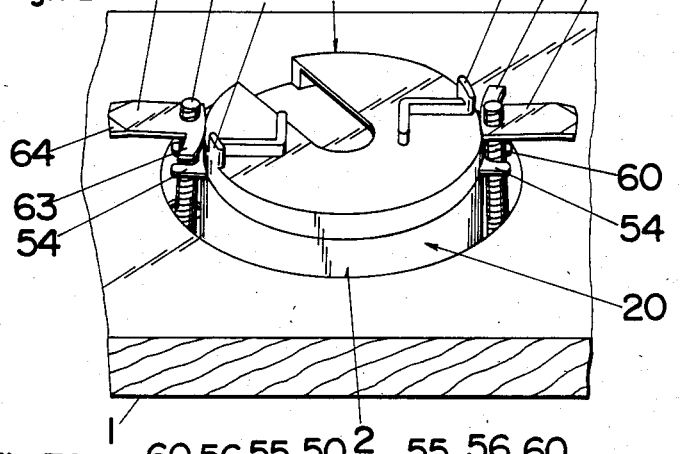
Figure 7C:
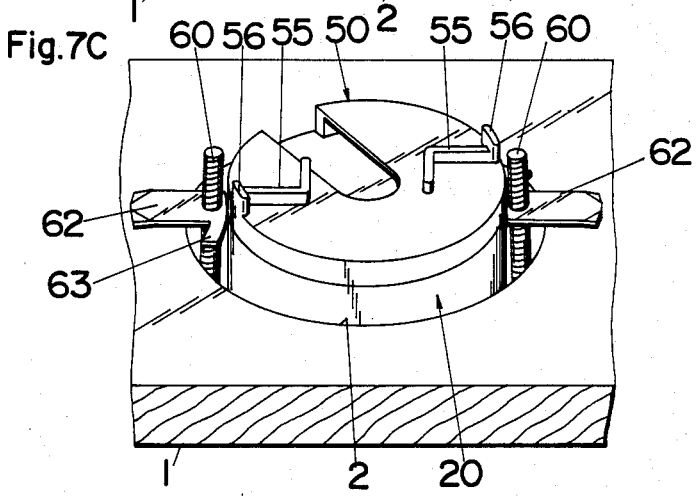
Figure 8:
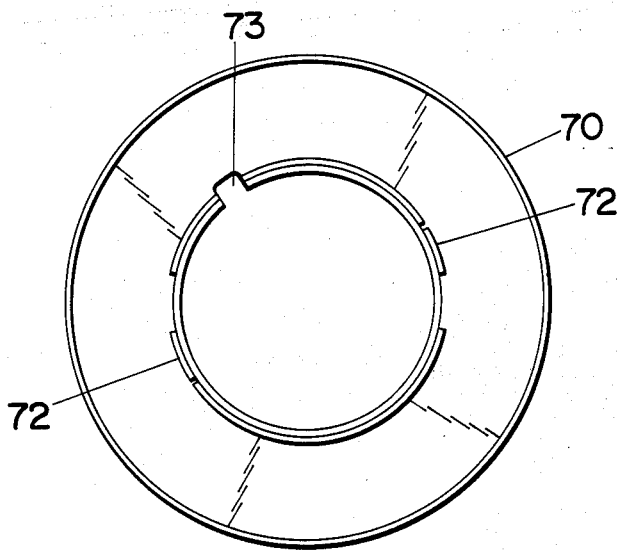
FIG. 8 is a top view of the bottom cover ring.
Figure 9:
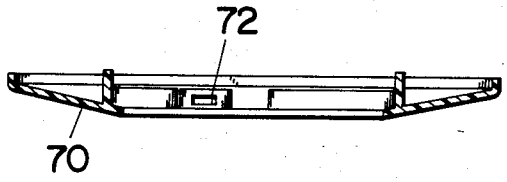
FIG. 9 is a sectional view of the bottom cover ring.

The mount base 20, which is provided in the form of a top-closed and bottom-opened cylindrical barrel having a flange 30 extending around the lower end thereof, is installed into an opening 2 formed in the ceiling surface or ceiling board 1, for example as shown in FIGS. 7A to 7C, and receives therein the major portion of the detector body 10 in such a manner as to expose substantially only the inlet port 13 Of the sensor unit 12. The mount base 20 is secured to the ceiling at the flange 30 by means of suitable screws. For this purpose, the flange 30 has two types of mount holes 31 and 32 one for securing the flange 30 directly to the ceiling surface, and the other for securing the flange 30 to a ceiling box (not shown) with corresponding threaded holes. In the illustrated embodiment, a clamp strip 72 is utilized in combination with each of fastening screws 60 for gripping the peripheral portion around the opening z of the ceiling surface 1 between the flange 30 and the clamp strips 72, the details of which will be discussed later.

Figure 4:
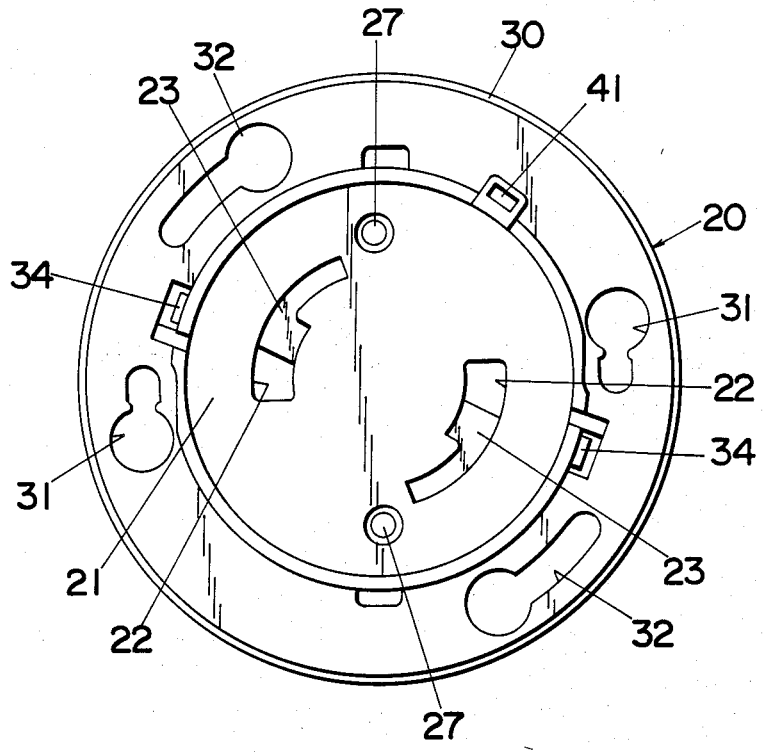
FIG. 4 is a bottom view of the mount base with a bottom cover ring detached therefrom.
Figure 5:
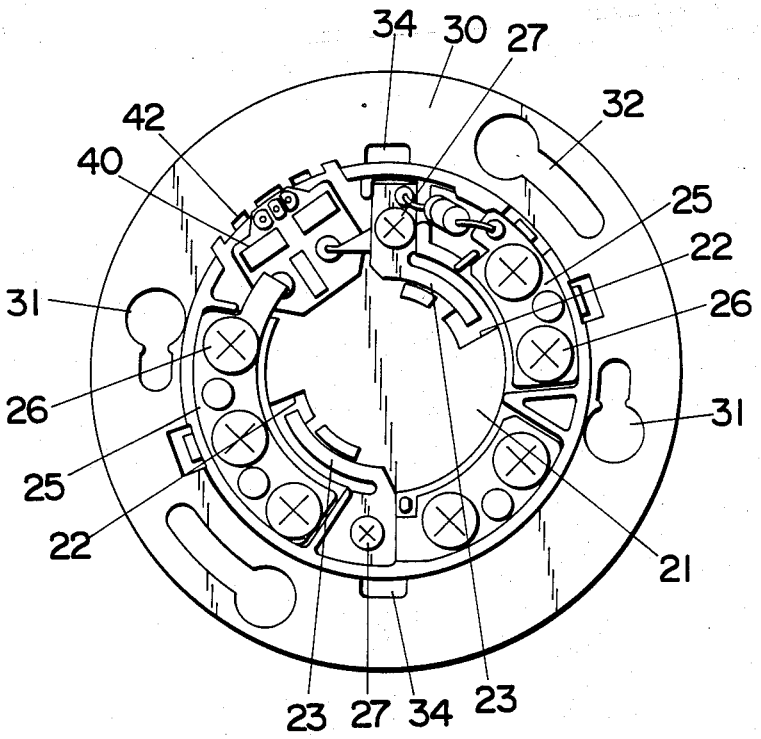
FIG. 5 is a top view of the mount base with a head cap and cover plate detached therefrom.

As shown in FIGS. 4 and 5, the mount base 20 has a top wall 21 somewhat recessed and formed with a pair of arcuate slots 22 extending circumferentially about an upright center axis of the mount base 20 in registration with the conductor prongs 15 on the detector body 10 so as to allow the detector body 10 to rotate about its center axis to some extent with the conductor prongs 15 extending upwardly through the respective slots 22. Mounted on the outer side of top wall 21 is a pair of sockets 23 for electrical and mechanical connections with the conductor prongs 15 of the detector body 10. Each socket 23 comprises a pair of upper and lower strips extending upwardly along the slot 22 and forming therebetween a click recess 24 for retaining the hook 16 of each conductor prong 15 after the detector body 10 is rotated. Thus, the detector body 10 is detachably supported on the mount base 20 by the detachable engagement of the conductor prongs 15 with the sockets 23.

Figure 6:
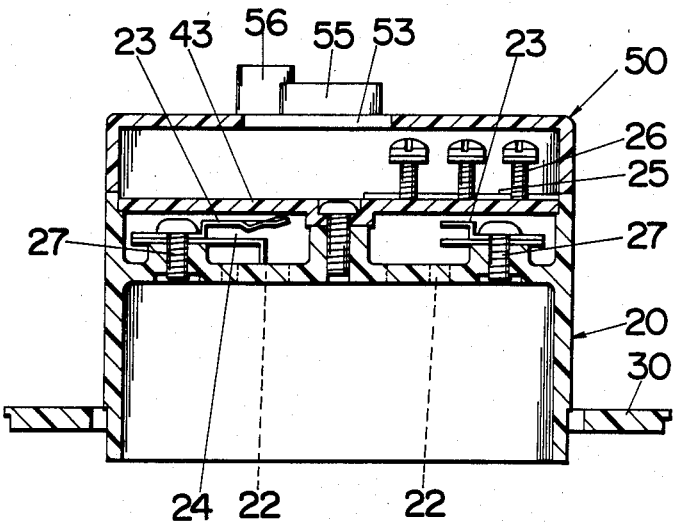
FIG. 6 is a sectional view of the mount base.

Also mounted exteriorly of the top wall 21 of the mount base 20 is a pair of terminals 25 with screws 26 for wiring connections with the signal line routed in the ceiling. The terminals 25 are positioned at the outwardmost portions on top of the mount base 20 in a radially outwardly spaced relation from the sockets 23 and electrically connected respectively therewith for completing the electric path from the conductor prongs 15 to the signal line. Additionally mounted on the periphery of the top wall 21 between one of the terminals 25 and the complementary socket 23 is a printed board 40 forming thereon a driver circuit for a test lamp 41 which indicates the actuation of the sensor unit 12. The test lamp 41 made of an LED is disposed on the lower surface of the flange 30 adjacent its inner periphery and is electrically connected to the circuit of the printed board 40 though conductor leads 42 extending vertically exteriorly along the side wall of the mount base do. The sockets 23 are respectively fastened to the top wall 21 respectively by screws 27 which extend into the inner surface of the top wall 21, as best seen in FIG. 6, to define a pair of test pins accessible from the below for receiving a test signal simulating a fire condition. Thus, the simulation of fire occurrence can be made simply by detaching the detector 10 from the mount base 20 and by conducting the test pin 27 such as by test probes from the below. It is noted at this time that only the pair of test pins 27 are exposed interiorly of the mount base do while the other pairs of conductive members, ire., terminals 25 and socket 23 are hidden therebehind such that the simulation by the test probes can be effected successfully without being interference with the other conductive members. When such simulation is made, the test lamp 41 responds to emit a light for confirmation of the normal system operation. A top cover 43 is secured to the top wall 21 for covering the sockets 23 and their connection with the terminals 25, the printed board 40, and the conductor leads 42 for external insulation thereof from the terminals 25.

Figure 3:
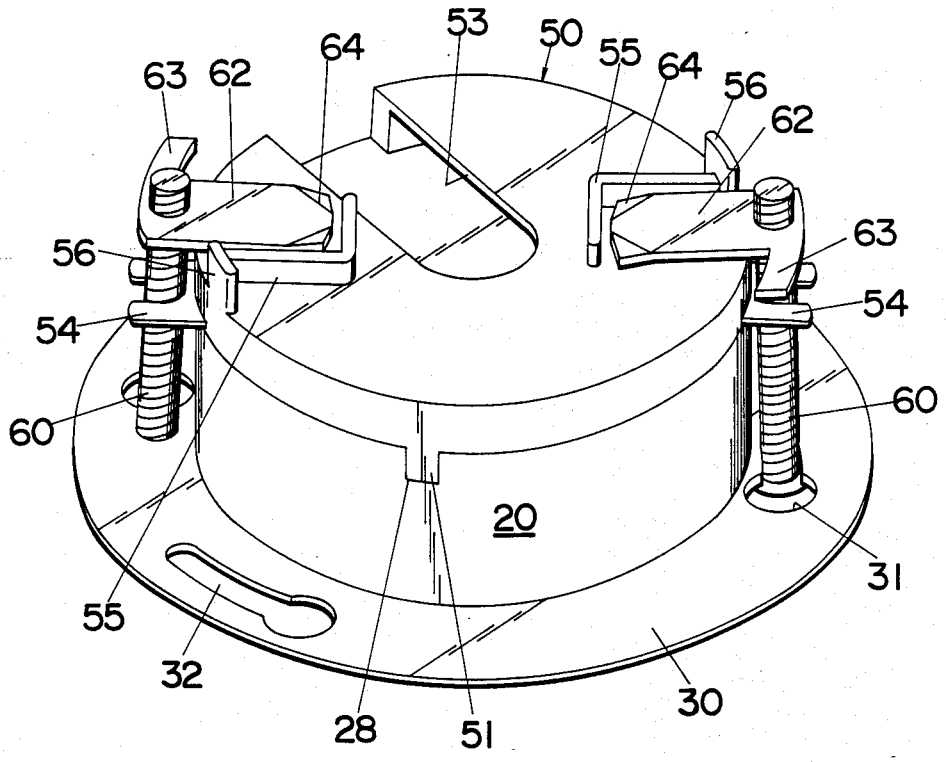
FIG. 3 is a perspective view of a mount base of the above assembly with fastening screws and head cover held thereon.

Associated with the mount base do is a head cap 50 of a plastic material which is detachable to the top of the mount base 20 by snap engagement of integral members 51 and 52 with corresponding notches 28 and 29 on the top periphery of the mount base 20. The head cap 50 is attached to the mount base 20 after completing the wire connections of the signal line to the terminals 25 in order to protect the wiring connections at the terminals 25 from possible hazard in the ceiling. As seen from FIGS. 1 to 3, the head cap 50 has a wiring slot $3 through which wires of the signal line are allowed to extend in one direction. The head cap 50 includes a pair of catches 54 integrally projecting radially outwardly therefrom to retain the upper ends of the fastening screws 60 extending respectively through the mounting holes 31 of the flange 30 such that the mount base 20 is handled as attaching the fastening screws 60 prior to being installed to the ceiling. This eliminates the necessity of separately handling the fastening screws by one hand while supporting the mount base by the other hand, thus leaving the one hand free to tighten the screws and therefore greatly enhancing the convenience of the installation procedure at an elevated position around the ceiling. Each fastening screw 60 has its upper end screwed into one longitudinal end of the clamp strip 62 so that the latter can be also held on the mount base 20 together with the fastening screws 60. Each clamp strip 62 is an elongated member formed at its one end with a stop tab 63 extending transversely and somewhat downwardly. The other end of the clamp strip 62 is bent downwardly to define thereat a bite end 64 for effecting firm grip to the ceiling surface. Prior to the installation of the mount base 20, each of the clamp plates 62 is held in position with its major portion rest on top of the head cap 50 and with its lateral edge engaged with an integral rib 55 on the head cap 50, as best shown in FIG. 3. Each of the rib 55 extends radially and terminates at the periphery of the head cap 50 to define thereat a stud 56 of which outer surface is flush with the outer side wall of the head cover 50 and the mount base 20.

The installation of the mount base 20 is now explained with reference to FIGS. 7A to 7C. Firstly, the mount base 20 is inserted into the opening 2 of the oeiling board 1 with its flange 30 abutted against the lower surface of the ceiling around the opening 2. In this position of FIG. 7A, the fastening screws 60 extend inside of the opening 2 with the clamp strips 62 kept resting on the head cap 50. As the fastening screw 60 is tightened from this position, the corresponding clamp strip 62 is rotated together with the screw 60 until the stop tab 63 abuts against the stud 56. That is, the clamp strip 62 is rotated about a half turn to project outwardly above the peripheral portion of the opening 2, as shown in FIG. 7B, after which the clamp strip 62 is kept its orientation due to the continued abutment of the stop tab 63 to the corresponding portion of the head cap 50 and the mount base 20 and is allowed to advance downwardly as the screw 60 is further tightened. As the fastening screw 60 is further tightened, the clamp strip 62 is finally pressed against the periphery of the opening 2 to thereby hold the same between the clamp strip 62 and the flange 30, as shown in FIG. 7C, thus completing to fix the mount base 20 to the ceiling 1. At this condition, the bite end 64 at the end of each clamp strip 62 is firmly engaged with the ceiling board 1 for enhanced firm grip therebetween. After installation of the mount base 20, a cover ring 70 is adapted to snap on the under surface of the flange 30 to conceal therebehind the heads of the respective fastening screws 60 as well as the mount holes 31 and 32 for providing an aesthetically pleasing finish. Such snap engagement of the cover ring 70 is effected by means of integral hooks 72 at the inner periphery of the cover ring 70 and corresponding latches 34 on the side of the flange 30. The cover ring 70 is also formed in its inner periphery with a notch 73 through which the test lamp 41 is viewed.

Figure 10:
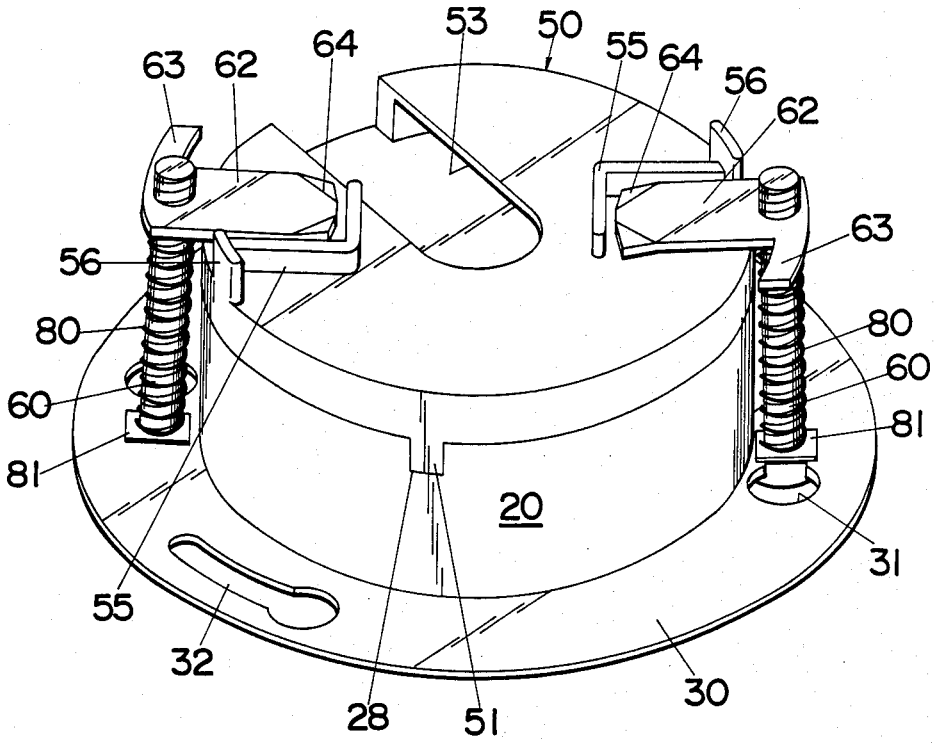
FIG. 10 is a perspective view of the mount base similar to FIG. 3 but with modified fastening screw and clamp strips combination.

FIG. 10 shows the same mount base 20 but with a modified configuration for holding the fastening screws 60 upright through the flange 30. In this modification, each fastening screw 60 extends through a coil spring 80 and loosely fitted at one end adjacent its head with a seat element 81. The coil spring 80 is compressed between the clamp strip 61 and the seat element 81 to thereby urge the seat element 81 against the upper surface of the flange 30 and at the same time urge the screw 60 itself upwardly at the clamp strip 62, so that the periphery of the mount hole 31 is kept gripped between the seat element 81 and the head of the screw 60. With this result, the screw 60 will receive a self-sustaining force to be held in an upright position even without the help of the catch 54 on the mount base do, and accordingly the screw do can be successfully tightened with the spring so being further compressed so as to grip the periphery of the opening 2 between the clamp strip 62 and the flange 30 for firm securing of the mount base 20 to the ceiling.

What is claimed is:

1. In a ceiling mounted fire detector assembly comprising:

a detector body and a mount base adapted to be secured to a ceiling surface and detachably receive therein said detector body;

said detector body including a sensor unit which produces an alarm signal upon sensing of a fire condition;

said detector body having on its top a set of conductor prongs for electrical and physical connections with a corresponding set of sockets provided on said mount base;

said mount base being in the form of a bottom-opened and top-closed barrel with a side wall and an outwardly extending flange at the lower end of said side wall and adapted to fit within an opening in the ceiling surface with said flange abutting against the lower ceiling surface around said opening, said flange having mount holes for securing said mount base to said ceiling surface;

said mount base having slots in the top wall through which said conductor prongs extend upwardly and come into electrical and mechanical engagement with said socket as said detector body is rotated about its upright center axis;

said mount base being provided with a set of terminals electrically interconnected to said set of sockets and adapted in use for wiring connection with a signal line routed in the ceiling in order to transmit the sensor output to said signal line;

said assembly characterized in that said set of terminals as well as said set of sockets are provided on the outer side of said top wall of said mount base such that said terminals are accessible exteriorly of said mount base for wiring connection with said signal line, in that a head cap is detachable to said mount base for shielding said terminals; and in that a bottom cover ring is attached to the undersurface of said flange to conceal said mount holes.

2. A ceiling mounted fire detector assembly as set forth in claim 1, wherein said mount base has at its lower end a test lamp and has on its top wall a printed board carrying a driving circuit of said test lamp, said driving circuit connected to said test lamp through conductor leads extending along the outer side of said side wall of said mount base such that said test lamp is turned on upon detection of fire by said sensor.

3. A ceiling mounted fire detector assembly as set forth in claim 2, wherein said mount base includes a pair of test pins which are electrically connected to said terminals respectively for transmitting a test signal simulating the detection of fire, one ends of said test pins being arranged to expose onto the interior surface of said top wall of said mount base to be readily accessible through the interior of said mount base.

4. A ceiling mounted fire detector assembly as set forth in claim 3, including an end cover attached to the top wall of said mount base to conceal thereunder said sockets, said printed board, and said conductor leads while exposing said terminals on the peripheral portion of the top wall of said mount base.

5. A ceiling mounted fire detector assembly as set forth in claim 1, including a set of fastening screws extending respectively through said mount holes and carrying clamp strips at their respective ends, each of said clamp strips threadedly engaged at its longitudinal end with said fastening screw with the major portion thereof restable upon the top wall of said mount base, each clamp strip having a stop tab projecting in the direction generally perpendicular to the lengthwise direction of said clamp strip such that as said fastening screw is tightened said stop tab becomes engaged with the side wall of said mount base after the said major portion of said clamp strip projecting outwardly so as to prevent said clamp strips from further rotating together with said fastening screws, thereby permitting said clamp strip to advance towards said flange as the fastening screw is further rotated in order to grip the periphery of said opening between said flange and said clamp strips.

6. A ceiling mounted fire detector assembly as set forth in claim 5, wherein said head cap has a wiring slot for passing therethrough wires of said signal line and has catches respectively for retaining the ends of said fastening screws to hold them in substantially upright positions on said mount base.

* * * * *